US008251544B2

(12) United States Patent
Ivey et al.

(10) Patent No.: US 8,251,544 B2
(45) **Date of Patent: *Aug. 28, 2012**

(54) LIGHTING INCLUDING INTEGRAL COMMUNICATION APPARATUS

(75) Inventors: John Ivey, Farmington Hills, MI (US); David L. Simon, Grosse Pointe Woods, MI (US)

(73) Assignee: Ilumisys, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/985,049

(22) Filed: Jan. 5, 2011

(65) Prior Publication Data

US 2011/0188240 A1 Aug. 4, 2011

Related U.S. Application Data

(63) Continuation of application No. 12/257,691, filed on Oct. 24, 2008, now Pat. No. 7,938,562.

(51) Int. Cl.
*F21V 33/00* (2006.01)

(52) U.S. Cl. ..... 362/276; 362/234; 362/253

(58) Field of Classification Search ..... 362/276, 362/234, 253, 295, 394, 411, 800, 802, 217.01–217.09, 362/217.1–217.17, 218–225

See application file for complete search history.

(56) References Cited

U.S. PATENT DOCUMENTS

| | | | |
|---|---|---|---|
| 54,511 | A | 2/1920 | Owen |
| 58,105 | A | 6/1921 | Poritz |
| 79,814 | A | 8/1929 | Hoch |
| 80,419 | A | 1/1930 | Kramer |
| 84,763 | A | 7/1931 | Stange |
| D119,797 | S | 4/1940 | Winkler et al. |
| D125,312 | S | 2/1941 | Logan |
| 2,909,097 | A | 10/1959 | Alden et al. |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |

(Continued)

FOREIGN PATENT DOCUMENTS

| | | | |
|---|---|---|---|
| CN | 1584388 | A | 2/2005 |

(Continued)

OTHER PUBLICATIONS

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

(Continued)

*Primary Examiner* — Bao Q Truong
(74) *Attorney, Agent, or Firm* — Young Basile

(57) ABSTRACT

A lighting and communication system for use in a standardized light fixture is provided. The lighting and communication system includes a light source and a communication apparatus, and the communication apparatus is at least one of an audio device or a camera. At least one electrical connector configured for physical and electrical connection to the standardized light fixture is included, and the at least one electrical connector is electrically connected to the light source and the communication apparatus.

24 Claims, 4 Drawing Sheets

U.S. PATENT DOCUMENTS

| | | | |
|---|---|---|---|
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,271,408 | A | 6/1981 | Teshima et al. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe et al. |
| 4,668,895 | A | 5/1987 | Schneiter |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,771,274 | A | 9/1988 | Havel |
| 4,780,621 | A | 10/1988 | Bartleucci et al. |
| 4,794,383 | A | 12/1988 | Havel |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,912,371 | A | 3/1990 | Hamilton |
| 4,922,154 | A | 5/1990 | Cacoub |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,979,081 | A | 12/1990 | Leach et al. |
| 4,980,806 | A | 12/1990 | Taylor et al. |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |
| 5,126,634 | A | 6/1992 | Johnson |
| 5,128,595 | A | 7/1992 | Hara |
| 5,130,909 | A | 7/1992 | Gross |
| 5,134,387 | A | 7/1992 | Smith et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,161,882 | A | 11/1992 | Garrett |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |
| 5,402,702 | A | 4/1995 | Hata |
| 5,404,282 | A | 4/1995 | Klinke et al. |
| 5,406,176 | A | 4/1995 | Sugden |
| 5,410,328 | A | 4/1995 | Yoksza et al. |
| 5,412,284 | A | 5/1995 | Moore et al. |

5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,475,300 A 12/1995 Havel
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,688,042 A 11/1997 Madadi et al.
5,697,695 A 12/1997 Lin et al.
5,701,058 A 12/1997 Roth
5,712,650 A 1/1998 Barlow
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,907,742 A 5/1999 Johnson et al.
5,912,653 A 6/1999 Fitch
5,921,660 A 7/1999 Yu
5,924,784 A 7/1999 Chliwnyj et al.
5,927,845 A 7/1999 Gustafson et al.
5,934,792 A 8/1999 Camarota
5,943,802 A 8/1999 Tijanic
5,946,209 A 8/1999 Eckel et al.
5,949,347 A 9/1999 Wu
5,951,145 A * 9/1999 Iwasaki et al. ..... 362/216
5,952,680 A 9/1999 Strite
5,959,547 A 9/1999 Tubel et al.
5,962,989 A 10/1999 Baker
5,962,992 A 10/1999 Huang et al.
5,963,185 A 10/1999 Havel
5,974,553 A 10/1999 Gandar
5,980,064 A 11/1999 Metroyanis
5,998,925 A 12/1999 Shimizu et al.
5,998,928 A 12/1999 Hipp
6,007,209 A 12/1999 Pelka
6,008,783 A 12/1999 Kitagawa et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,238,075 B1 5/2001 Dealey, Jr. et al.
6,241,359 B1 6/2001 Lin 6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,369,525 B1 4/2002 Chang et al.
6,371,637 B1 4/2002 Atchinson et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
D458,395 S 6/2002 Piepgras et al.
6,400,096 B1 6/2002 Wells et al.
6,404,131 B1 6/2002 Kawano et al.
6,411,022 B1 6/2002 Machida
6,422,716 B2 7/2002 Henrici et al.
6,428,189 B1 8/2002 Hochstein
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
6,585,393 B1 7/2003 Brandes et al.
6,586,890 B2 7/2003 Min et al.
6,590,343 B2 7/2003 Pederson
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,612,712 B2 9/2003 Nepil
6,612,717 B2 9/2003 Yen
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
6,909,239 B2 6/2005 Gauna
6,909,921 B1 6/2005 Bilger
6,918,580 B2 7/2005 Seeberger et al.
6,918,680 B2 7/2005 Seeberger
6,921,181 B2 7/2005 Yen
6,936,968 B2 8/2005 Cross et al.
6,936,978 B2 8/2005 Morgan et al.
6,940,230 B2 9/2005 Myron et al.
6,948,829 B2 9/2005 Verdes et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
7,004,603 B2 2/2006 Knight D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,021,799 B2 4/2006 Mizuyoshi
7,021,809 B2 4/2006 Iwasa et al.
7,024,256 B2 4/2006 Krzyzanowski et al.
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge et al.
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,198,387 B1 4/2007 Gloisten et al.
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich et al.
7,211,959 B1 5/2007 Chou
7,213,934 B2 5/2007 Zarian et al.
7,217,004 B2 5/2007 Park et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,220,018 B2 5/2007 Crabb et al.
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno et al.
7,259,528 B2 8/2007 Pilz
7,262,439 B2 8/2007 Setlur et al.
7,264,372 B2 9/2007 Maglica
7,267,467 B2 9/2007 Wu et al.
7,270,443 B2 9/2007 Kurtz et al.
7,271,794 B1 9/2007 Cheng et al.
7,273,300 B2 9/2007 Mrakovich
7,274,045 B2 9/2007 Chandran et al.
7,274,160 B2 9/2007 Mueller et al.
D553,267 S 10/2007 Yuen
7,285,801 B2 10/2007 Eliashevich et al.
7,288,902 B1 10/2007 Melanson
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,327,281 B2 2/2008 Hutchison
7,329,031 B2 2/2008 Liaw et al.
D563,589 S 3/2008 Hariri et al.
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,374,327 B2 5/2008 Schexnaider
7,385,359 B2 6/2008 Dowling et al.
7,391,159 B2 6/2008 Harwood
7,396,146 B2 7/2008 Wang
7,401,935 B2 7/2008 VanderSchuit
7,401,945 B2 7/2008 Zhang
7,427,840 B2 9/2008 Morgan et al.
7,429,117 B2 9/2008 Pohlert et al.
7,434,964 B1 10/2008 Zheng et al.
7,438,441 B2 10/2008 Sun et al.

D580,089 S 11/2008 Ly et al.
D581,556 S 11/2008 To et al.
7,449,847 B2 11/2008 Schanberger et al.
D582,577 S 12/2008 Yuen
D584,428 S 1/2009 Li et al.
7,476,002 B2 1/2009 Wolf et al.
7,476,004 B2 1/2009 Chan
7,478,924 B2 1/2009 Robertson
D586,484 S 2/2009 Liu et al.
D586,928 S 2/2009 Liu et al.
7,490,957 B2 2/2009 Leong et al.
7,497,596 B2 3/2009 Ge
7,507,001 B2 3/2009 Kit
7,510,299 B2 3/2009 Timmermans et al.
7,520,635 B2 4/2009 Wolf et al.
7,521,872 B2 4/2009 Bruning
7,524,089 B2 4/2009 Park
D593,223 S 5/2009 Komar
7,534,002 B2 5/2009 Yamaguchi et al.
7,549,769 B2 6/2009 Kim et al.
7,556,396 B2 7/2009 Kuo et al.
7,572,030 B2 8/2009 Booth et al.
7,575,339 B2 8/2009 Hung
7,579,786 B2 8/2009 Soos
7,583,035 B2 9/2009 Shteynberg et al.
7,602,559 B2 10/2009 Jang et al.
7,619,366 B2 11/2009 Diederiks
7,635,201 B2 12/2009 Deng
7,639,517 B2 12/2009 Zhou et al.
D612,528 S 3/2010 McGrath et al.
7,690,813 B2 4/2010 Kanamori et al.
7,710,047 B2 5/2010 Shteynberg et al.
7,712,918 B2 5/2010 Siemiet et al.
7,828,471 B2 11/2010 Lin
7,843,150 B2 11/2010 Wang et al.
7,938,562 B2 * 5/2011 Ivey et al. ..... 362/276
2001/0033488 A1 10/2001 Chliwnyj et al.
2001/0045803 A1 11/2001 Cencur
2002/0038157 A1 3/2002 Dowling et al.
2002/0044066 A1 4/2002 Dowling et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0028260 A1 2/2003 Blackwell
2003/0031015 A1 2/2003 Ishibashi
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0222587 A1 12/2003 Dowling, Jr. et al.
2004/0003545 A1 1/2004 Gillespie
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0116039 A1 6/2004 Mueller et al.
2004/0124782 A1 7/2004 Yu
2004/0130909 A1 7/2004 Mueller et al.
2004/0141321 A1 7/2004 Dowling et al.
2004/0155609 A1 8/2004 Lys et al.
2004/0160199 A1 8/2004 Morgan et al.
2004/0178751 A1 9/2004 Mueller et al.
2004/0189218 A1 9/2004 Leong et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0257007 A1 12/2004 Lys et al.
2005/0013133 A1 1/2005 Yeh
2005/0259424 A1 1/2005 Zampini, II et al.
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0248299 A1 11/2005 Chemel et al.
2005/0253533 A1 11/2005 Lys et al.
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.

2005/0276064 A1 12/2005 Wu et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0076908 A1 4/2006 Morgan et al.
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0221606 A1 10/2006 Dowling
2006/0221619 A1 10/2006 Nishigaki
2006/0232974 A1 10/2006 Lee et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0273741 A1 12/2006 Stalker et al.
2006/0274529 A1 12/2006 Cao
2006/0285325 A1 12/2006 Ducharme et al.
2007/0035255 A1 2/2007 Shuster et al.
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1* 5/2007 Wolf et al. ..... 362/86
2007/0115658 A1 5/2007 Mueller et al.
2007/0115665 A1 5/2007 Mueller et al.
2007/0120594 A1 5/2007 Balakrishnan et al.
2007/0127234 A1 6/2007 Jervey, III
2007/0133202 A1 6/2007 Huang et al.
2007/0139938 A1 6/2007 Petroski et al.
2007/0145915 A1 6/2007 Roberge et al.
2007/0147046 A1 6/2007 Arik et al.
2007/0152797 A1 7/2007 Chemel et al.
2007/0153514 A1 7/2007 Dowling et al.
2007/0159828 A1 7/2007 Wang
2007/0165402 A1 7/2007 Weaver, Jr. et al.
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0205712 A1 9/2007 Radkov et al.
2007/0206375 A1 9/2007 Piepgras et al.
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247842 A1 10/2007 Zampini et al.
2007/0247847 A1 10/2007 Villard
2007/0247851 A1 10/2007 Villard
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0037245 A1 2/2008 Chan
2008/0037284 A1 2/2008 Rudisill
2008/0062680 A1 3/2008 Timmermans et al.
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094837 A1 4/2008 Dobbins et al.
2008/0130267 A1 6/2008 Dowling et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0211419 A1 9/2008 Garrity
2008/0224629 A1 9/2008 Melanson
2008/0224636 A1 9/2008 Melanson
2008/0253125 A1 10/2008 Kang et al.
2008/0258647 A1 10/2008 Scianna
2008/0285257 A1 11/2008 King
2008/0285266 A1 11/2008 Thomas
2008/0290814 A1 11/2008 Leong et al.
2008/0291675 A1 11/2008 Lin et al.
2008/0315773 A1 12/2008 Pang
2008/0315784 A1 12/2008 Tseng
2009/0002995 A1 1/2009 Lee et al.
2009/0016063 A1 1/2009 Hu
2009/0046473 A1 2/2009 Tsai et al.
2009/0052186 A1 2/2009 Xue
2009/0067182 A1 3/2009 Hsu et al.
2009/0086492 A1 4/2009 Meyer
2009/0091938 A1 4/2009 Jacobson et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0273926 A1 11/2009 Deng
2009/0303720 A1 12/2009 McGrath
2009/0316408 A1 12/2009 Villard
2010/0008085 A1 1/2010 Ivey et al.
2010/0019689 A1 1/2010 Shan
2010/0027259 A1 2/2010 Simon et al.

| | | | |
|---|---|---|---|
| 2010/0033095 | A1 | 2/2010 | Sadwick |
| 2010/0033964 | A1 | 2/2010 | Choi et al. |
| 2010/0096998 | A1 | 4/2010 | Beers |

FOREIGN PATENT DOCUMENTS

| | | | |
|---|---|---|---|
| CN | 2766345 | Y | 3/2006 |
| CN | 2869556 | Y | 2/2007 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0197602 | B1 | 11/1990 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0359329 | B1 | 3/1994 |
| EP | 0403011 | B1 | 4/1994 |
| EP | 0632511 | A2 | 1/1995 |
| EP | 0432848 | B1 | 4/1995 |
| EP | 0403001 | B1 | 8/1995 |
| EP | 0525876 | B1 | 5/1996 |
| EP | 0714556 | B1 | 1/1999 |
| EP | 0458408 | B1 | 9/1999 |
| EP | 0578302 | B1 | 9/1999 |
| EP | 0723701 | B1 | 1/2000 |
| EP | 0787419 | B1 | 5/2001 |
| EP | 1195740 | A2 | 4/2002 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1142452 | B1 | 3/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | A2 | 12/2005 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | B1 | 6/2007 |
| EP | 0922305 | B1 | 8/2007 |
| EP | 0922306 | B1 | 8/2007 |
| EP | 1194918 | B1 | 8/2007 |
| EP | 1048085 | B1 | 11/2007 |
| EP | 1763650 | B1 | 12/2007 |
| EP | 1776722 | B1 | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1157428 | B1 | 9/2008 |
| EP | 1337784 | B1 | 6/2009 |
| GB | 2215024 | A | 9/1989 |
| GB | 2324901 | A | 11/1998 |
| JP | 6-54103 | U | 7/1994 |
| JP | H6-54103 | | 7/1994 |
| JP | 7-249467 | | 9/1995 |
| JP | 08-162677 | | 6/1996 |
| JP | 11-135274 | A | 5/1999 |
| JP | 2001-238272 | A | 8/2001 |
| JP | 2002-141555 | A | 5/2002 |
| JP | 3098271 | U | 2/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 3139714 | U | 2/2008 |
| JP | 2008-258124 | A | 10/2008 |
| KR | 10-2004-0008244 | A | 1/2004 |
| KR | 20-0430022 | Y1 | 11/2006 |
| KR | 10-0781652 | B1 | 12/2007 |
| TW | M337036 | | 7/2008 |
| WO | 9906759 | A1 | 2/1999 |
| WO | 99/10867 | A1 | 3/1999 |
| WO | 99/31560 | A2 | 6/1999 |
| WO | 9945312 | A1 | 9/1999 |
| WO | 00/01067 | A2 | 1/2000 |
| WO | 02/25842 | A2 | 3/2002 |
| WO | 02/061330 | A2 | 8/2002 |
| WO | 02/069306 | A2 | 9/2002 |
| WO | 02/091805 | A2 | 11/2002 |
| WO | 02/098182 | A2 | 12/2002 |
| WO | 02/099780 | A2 | 12/2002 |
| WO | 03/026358 | A1 | 3/2003 |
| WO | 03/055273 | A2 | 7/2003 |
| WO | 03/067934 | A2 | 8/2003 |
| WO | 03/090890 | A1 | 11/2003 |
| WO | 03/096761 | A1 | 11/2003 |
| WO | 2004/021747 | A2 | 3/2004 |
| WO | 2004/023850 | A2 | 3/2004 |
| WO | 2004/032572 | A2 | 4/2004 |
| WO | 2004/100624 | A2 | 11/2004 |
| WO | 2005031860 | A2 | 4/2005 |
| WO | 2005/052751 | A2 | 6/2005 |
| WO | 2005/060309 | A2 | 6/2005 |
| WO | 2005/084339 | A2 | 9/2005 |
| WO | 2005/089293 | A2 | 9/2005 |
| WO | 2005/089309 | A2 | 9/2005 |
| WO | 2006/023149 | A2 | 3/2006 |
| WO | 2006044328 | A1 | 4/2006 |
| WO | 2006056120 | A1 | 6/2006 |
| WO | 2006/093889 | A2 | 9/2006 |
| WO | 2006/127666 | A2 | 11/2006 |
| WO | 2006/127785 | A2 | 11/2006 |
| WO | 2006/133272 | A2 | 12/2006 |
| WO | 2006137686 | A1 | 12/2006 |
| WO | 2007/081674 | A1 | 7/2007 |
| WO | 2007/094810 | A2 | 8/2007 |
| WO | 2007090292 | A1 | 8/2007 |
| WO | 9957945 | A1 | 9/2009 |

OTHER PUBLICATIONS

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.

Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.

Telecite Products & Services—Display Options, [online], [retrieved on Jan. 13, 2000] Retrieved from Telecite Web page using Internet <URL: http://www.telecite.com/en/products/options en.htm>.

Traffic Signal Products—Transportation Products Group, [online], [retrieved on Jan. 13, 2000] Retrieved from the Dialight Web Page using Internet <URL: http://www.dialight.com/trans.htm>.

LED Lights, Replacement LED lamps for any incandescent light, [online], [retrieved on Jan. 13, 2000] Retrieved from LED Lights Web Page using Internet <URL: http://www.ledlights.com/replac.htm>.

LEDTRONICS, LEDTRONICS Catalog, 1996, p. 10, LEDTRONICS, Torrance, California.
Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.
Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.
Phason Electronic Control Systems, Light Level Controller (LLC) case study. Nov. 30, 2004. 3 pages, Phason Inc., Winnipeg, Manitoba, Canada.
Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.
D.N.A.-III, [online], [retrieved Mar. 10, 2009 ] Retrieved from the PLC Lighting Web Page using Internet <URL: http://www.plclighting.com/product_info.php?cPath=1&products_id=92>.
E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.
E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.
E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.
E22201-44 Esprit Collection, [online], [retrieved on Jul. 10, 2010] Retrieved from ET2 Contemporary Lighting using Internet <URL: http://www.et2online.com/proddetail.aspx?ItemID=E22201-44>.
E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.
Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.encelium.com/products/strategies.html>.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.
Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr . . . >.
Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.

* cited by examiner

LIGHTING INCLUDING INTEGRAL COMMUNICATION APPARATUS

CROSS-REFERENCE TO RELATED APPLICATIONS

This application is a continuation of U.S. patent application Ser. No. 12/257,691, filed Oct. 24, 2008, which is incorporated herein by reference in its entirety.

TECHNICAL FIELD

The present invention relates to building communication systems, and more particularly to integrating building communication system components with building lighting.

BACKGROUND

Many buildings have lighting systems. For example, many commercial buildings include fluorescent lighting fixtures for use with fluorescent tubes, though other types of lighting systems using other types of lights (e.g., incandescent lights) may also be used. Fixtures are typically hard-wired to a power source, such as an electric utility line. The lighting system may produce a generally constant flux of light so long as a switch controlling the lighting system is in an "on" position. Typically, the sole function of lighting systems is providing light.

Many buildings also have one or more sound systems. For example, an alarm sound system may be part of an alarm system for notifying building occupants of an emergency. While alarm sound systems may include emergency lighting, the emergency lighting is typically active only during the emergency to supplement the notice of the emergency provided by the alarm sound. The emergency lighting included with some sound systems, such as a strobe light, is typically not designed to provide normal lighting for a building. Another type of sound system includes speakers for making announcements. Such speakers typically do not include lighting. Sound systems, including both the alarm sound system and announcement speakers, typically are separate from and operate independently of lighting systems.

Many buildings also have one or more cameras for security purposes. Most cameras are separate from and operate independently of both lighting systems and sound systems.

BRIEF SUMMARY

Embodiments of the present invention provide a lighting and communication system for use in a standardized light fixture. The lighting and communication system includes a light source and a communication apparatus. The communication apparatus is at least one of an audio device or a camera. The system further includes at least one electrical connector configured for physical and electrical connection to the standardized light fixture. The at least one electrical connector is electrically connected to the light source and the communication apparatus.

In another example, an LED-based light including a lighting and communication system for use in a fluorescent fixture is provided. The LED-based light includes at least one LED and a communication apparatus. The communication apparatus is at least one of an audio device or a camera. A pair of pin-carrying connectors is included for physical and electrical connection to the fluorescent fixture, and the connectors are electrically connected to the LEDs and the communication apparatus.

In yet another example, a lighting and communication system for use in a standardized light fixture is provided. The lighting and communication system includes a light source and a communication apparatus. The communication apparatus is at least one of an audio device or a camera, and a controller is operative to control a brightness of the light source in response to an input signal received from the communications apparatus.

These and other embodiments will be described in additional detail hereafter.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
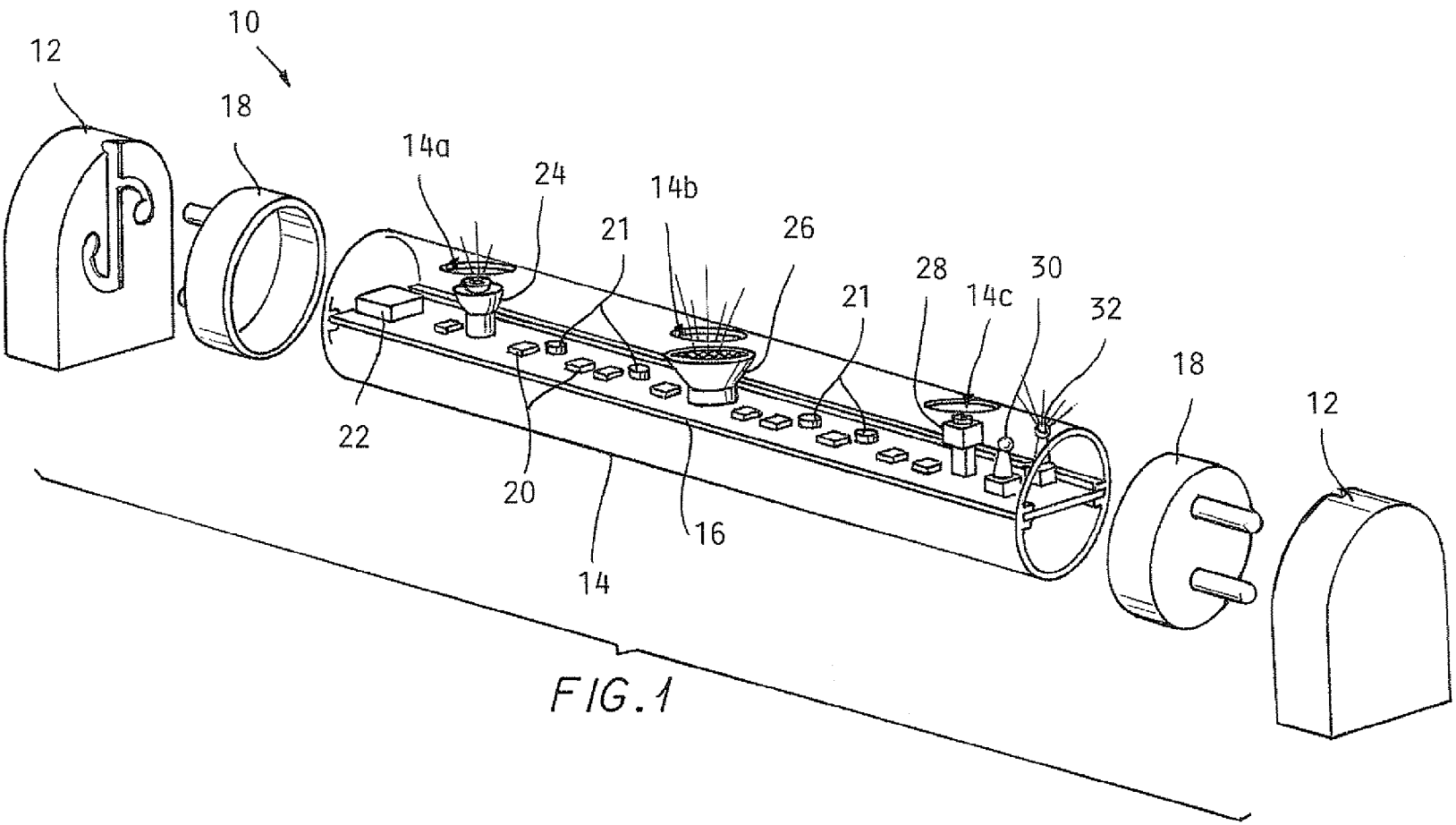
FIG. 1 is a perspective view of an example of a light and communication system.

Examples of light and communication systems according to the invention are discussed with reference to FIGS. 1-4. FIG. 1 illustrates a light and communication system 10 for use in a standard fixture 12, such as a fixture designed to accept T5, T8, T10, or T12 tubes. As such, the system 10 can have the shape of a standard tube, i.e., the shape of a T5, T8, T10, or T12 tube, or otherwise be shaped for compatibility with the standard fixture 12. Alternatively, another example of a light and communication system can have an alternative shape from the illustrated system 10 for use in fixtures that accept other types of standard sized lights, such as the shape of an incandescent bulb as shown in FIG. 4 or standard sized halogen lamps. However, all examples of light and communication systems need not be compatible with the fixture 12 or another type of standard fixture. That is, yet another example of a light and communication system can be powered by a battery or connected to a power source by means such as hard-wiring the system to a power source.

As shown in FIG. 1, the light and communication system 10 includes a housing 14, a circuit board 16, a pair of end caps 18, LEDs 20, a controller 22, an audio device including a microphone 24 and a speaker 26, a camera 28, a receiver 30, and a transmitter 32. The housing 14 as shown in FIG. 1 is a light transmitting cylindrical tube. The housing 14 can be made from polycarbonate, acrylic, glass or another light transmitting material (i.e., the housing 14 can be transparent or translucent). For example, a translucent housing 14 can be made from a composite, such as polycarbonate with particles of a light refracting material interspersed in the polycarbonate. While the illustrated housing 14 is cylindrical, a housing having a square, triangular, polygonal, or other cross sectional shape can alternatively be used. Similarly, while the illustrated housing 14 is linear, a housing having an alternative shape, e.g., a U-shape or a circular shape can alternatively be used. Additionally, the housing 14 need not be a single piece as shown in FIG. 1. Instead, another example of a housing can be formed by attaching multiple individual parts, not all of which need be light transmitting. For example, such a housing can include an opaque lower portion and a lens or other transparent cover attached to the lower portion to cover the LEDs 20. The housing 14 can be manufactured to include light diffusing or refracting properties, such as by surface roughening or applying a diffusing film to the housing 14. For compatibility with the fixture 12 as discussed above, the housing 14 can have a length such that the light 10 is approximately 48" long, and the housing 14 can have a 0.625", 1.0", or 1.5" diameter. The housing 14 can define first, second, and third apertures 14*a*, 14*b*, and 14*c* as discussed below.

The circuit board 16 as illustrated in FIG. 1 is an elongate printed circuit board. Multiple circuit board sections can be joined by bridge connectors to create the circuit board 16. The circuit board 16 as shown in FIG. 1 is slidably engaged with the housing 14, though the circuit board 16 can alternatively be clipped, adhered, snap- or friction-fit, screwed or otherwise connected to the housing 14. For example, the circuit board 16 can be mounted on a heat sink that is attached to the housing 14. Also, other types of circuit boards may be used, such as a metal core circuit board. Or, instead of a circuit board 16, other types of electrical connections (e.g., wires) can be used to electrically connect the LEDs 20 to a power source.

The light and communication system 10 can include two bi-pin end caps 18 (i.e., each end cap 18 can carry two pins), one at each longitudinal end of the housing 14, for physically and electrically connecting the system 10 to the fixture 12. The end caps 18 can be the sole physical connection between the light and communication system 10 and the fixture 12. The end caps 18 can be electrically connected to the circuit board 16 to provide power to the LEDs 20 and other components (e.g., the microphone 24, speaker 26, and camera 28). Each end cap 18 can include two pins, though two of the total four pins can be "dummy pins" that do not provide an electrical connection. Alternatively, other types of electrical connectors can be used, such as an end cap carrying a single pin. Also, while the end caps 18 are shown as including cup-shaped bodies, apparatuses having a different configuration can alternatively be used (e.g., plugs lodged in ends of the housing 14 can carry pins or other electrical connectors). One or both of the end caps 18 can additionally include electric components, such as a rectifier and filter.

The LEDs 20 can be surface-mount devices of a type available from Nichia, though other types of LEDs can alternatively be used. For example, although surface-mounted LEDs 20 are shown, one or more organic LEDs can be used in place of or in addition thereto. The LEDs 20 can be mounted to the circuit board 16 by solder, a snap-fit connection, or other means. The LEDs 20 can produce white light. However, LEDs that produce blue light, ultra-violet light or other wavelengths of light can be used in place of white light emitting LEDs 20. Additionally, notification LEDs 21 can be included. Notification LEDs 21 can be identical to LEDs 20, except notification LEDs 21 can produce a different color of light than LEDs 20 (e.g., if the LEDs 20 produce white light as described above, notification LEDs 21 can produce red light).

The number of LEDs 20 can be a function of the desired amount of light produced by the light and communication system 10 and the power of the LEDs 20. For a 48" light, such as the illustrated light and communication system 10, the number of LEDs 20 can vary from about five to four hundred such that the system 10 outputs approximately 500 to 3,000 lumens. However, a different number of LEDs 20 can alternatively be used, and the system 10 can output a different amount of lumens. The LEDs 20 can be evenly spaced along the circuit board 16, and the spacing of the LEDs 20 can be determined based on, for example, the light distribution of each LED 20 and the number of LEDs 20.

The controller 22 can be digital and include a CPU and a memory, such as RAM or another type of memory, though a controller including analog circuits can be used. The controller 22 can be mounted on the circuit board 16 to receive power from one or both of the end caps 18, though the controller 22 can be coupled to a different power source such as a battery. The controller 22 can also be in communication with the LEDs 20 and 21, the microphone 24, the speaker 26, the camera 28, the receiver 30, and the transmitter 32. The memory can store a program for determining an operating mode of at least some components of the system 10, such as the LEDs 20, the microphone 24, the speaker 26, and the camera 28. Additionally, the memory can store sound files for transmission to the speaker 26, and the memory can include empty space for storing sound files corresponding to sounds captured by the microphone 24. The functionality of the controller 22 is discussed below in greater detail in reference to FIGS. 2 and 3.

The audio device can include the microphone 24 and the speaker 26 as mentioned above. The microphone 24 can be positioned to capture sound waves produced outside the housing 14. For example, the housing 14 can define the first aperture 14*a*, and the microphone 24 can be positioned adjacent the first aperture 14*a* such that sound waves produced outside the housing 14 can reach the microphone 24 to avoid sound waves having to pass through the housing 14 to reach the microphone 24. While not illustrated, the microphone 24 can substantially fill the aperture 14*a*, and a seal can be included between the microphone 24 and aperture 14*a* to protect the circuit board 16 and other components inside the housing 14. As another example, the microphone 24 can be mounted to an exterior of the housing 14. The microphone 24 can be in communication with the controller 22 and/or the transmitter 32. The microphone 24 can be mounted on the circuit board 16 for receiving power passing from the fixture 12 to the circuit board 16 via at least one of the end caps 18 and for communicating the audio input signal to the controller 22 and/or the transmitter 32. Alternatively, the microphone 24 can be powered by another power source (e.g., a battery). The microphone 24 can produce an audio input signal $\alpha$ corresponding to captured sound waves, and the microphone 24 can communicate the audio input signal $\alpha$ to the controller 22 and the transmitter 32.

The speaker 26 can be positioned to produce sound waves that travel outside the housing 14. For example, the housing 14 can define the second aperture 14*b*, and the speaker 26 can be positioned adjacent to the second aperture 14*b* such that sound waves produced by the speaker 26 can pass unobstructed (e.g., without having to pass through the housing 14) to an area outside the housing 14. While not illustrated, the speaker 26 can substantially fill the aperture 14*b*, and a seal can be included between the speaker 26 and aperture 14*b* to protect the circuit board 16 and other components inside the housing 14. Alternatively, the speaker 26 can be mounted at an alternative location, such as on an exterior of the housing 14. The speaker 26 can be mounted on the circuit board 16 for receiving power passing from the fixture 12 to the circuit board 16 via at least one of the end caps 18, though the speaker 26 can alternatively be powered by another power source (e.g., a battery), and for communication with the controller 22 and/or the receiver 30. The speaker 26 can transform an audio output signal $\beta$ communicated from the controller 22 or receiver 30 into audible sound waves. Additionally, more than one speaker 26 can be included.

The camera 28 can be positioned to capture video or still images of an area outside the housing 14. For example, the housing 14 can define the third aperture 14*c*, and a lens of the camera 28 can be positioned adjacent the third aperture 14*c* such that light waves can pass unobstructed from outside the housing 14 to the lens of the camera 28. While not illustrated, the camera 28 can substantially fill the aperture 14*c*, and a seal can be included between the camera 28 and aperture 14*c* to protect the circuit board 16 and other components inside the housing 14. As another example, the camera 28 can be mounted on an exterior of the housing 14, or the camera 28 can be mounted to face a transparent portion of the housing 14 through which the camera 28 can capture images. The camera 28 can be electrically coupled to the circuit board 16 to receive power from the end caps 18 and for communication with the controller 22 and/or the transmitter 30. Alternatively, the camera 28 can be powered by another source (e.g., a battery), and the camera 28 can communicate with the controller 22 and/or transmitter 30 wirelessly or via a hard-wire not integral with the circuit board 16. The camera 28 can also include additional equipment. For example, the camera 28 can be mounted on a motorized pivot for movement tracking of an object moving relative to the system 10, or the camera 28 can be mounted on an adjustable pivot such that the camera 28 can be oriented to capture images of a certain area of a room when installed in the fixture 12. The camera 28 can output an image signal γ corresponding to either still images or video to the controller 22 and/or transmitter 32.

The receiver 30 can be in communication with a remote source, such as a security center, for receiving the audio output signal β. The receiver 30 can be in wireless communication with the remote source using a standard wireless protocol such as IEEE 802.11, a protocol for radio communication, Bluetooth, a cellular standard (e.g., 3G), or another wireless protocol. Alternatively, the receiver 30 can be hard-wired in communication with the remote source using a telephone line, an Ethernet line, an electrical line, or another physical coupling. The receiver 30 can be mounted on the circuit board 16 for receiving power from the end caps 18 and for communication with the controller 22 and/or the speaker 26. Alternatively, the receiver 30 can be powered by a different source (e.g., a battery) and be coupled to the controller 22 and/or speaker 26 wirelessly or through a hard wire not integral with the circuit board 16. The receiver 30 can receive also receive a control signal δ including instructions for controlling the LEDs 20, the notification LEDs 21, the speaker 26, and/or the camera 28.

The transmitter 32 can also be in communication with the remote source for transmitting at least one of the audio input signal α and the image signal γ to the remote source. The transmitter 32 can be in wireless communication with the remote source using one of the wireless protocols mentioned above, or the transmitter 32 can be hard-wired to the remote source. The transmitter 32 can be mounted on the circuit board 16 for receiving power from the end caps 32 and for communication with the controller 22, the microphone 24, and/or the camera 28. Alternatively, the transmitter 30 can be powered by a different source (e.g., a battery) and can be coupled to the controller 22, audio device, and/or camera 28 wirelessly or through a hard wire not integral with the circuit board 16.

Figure 2:
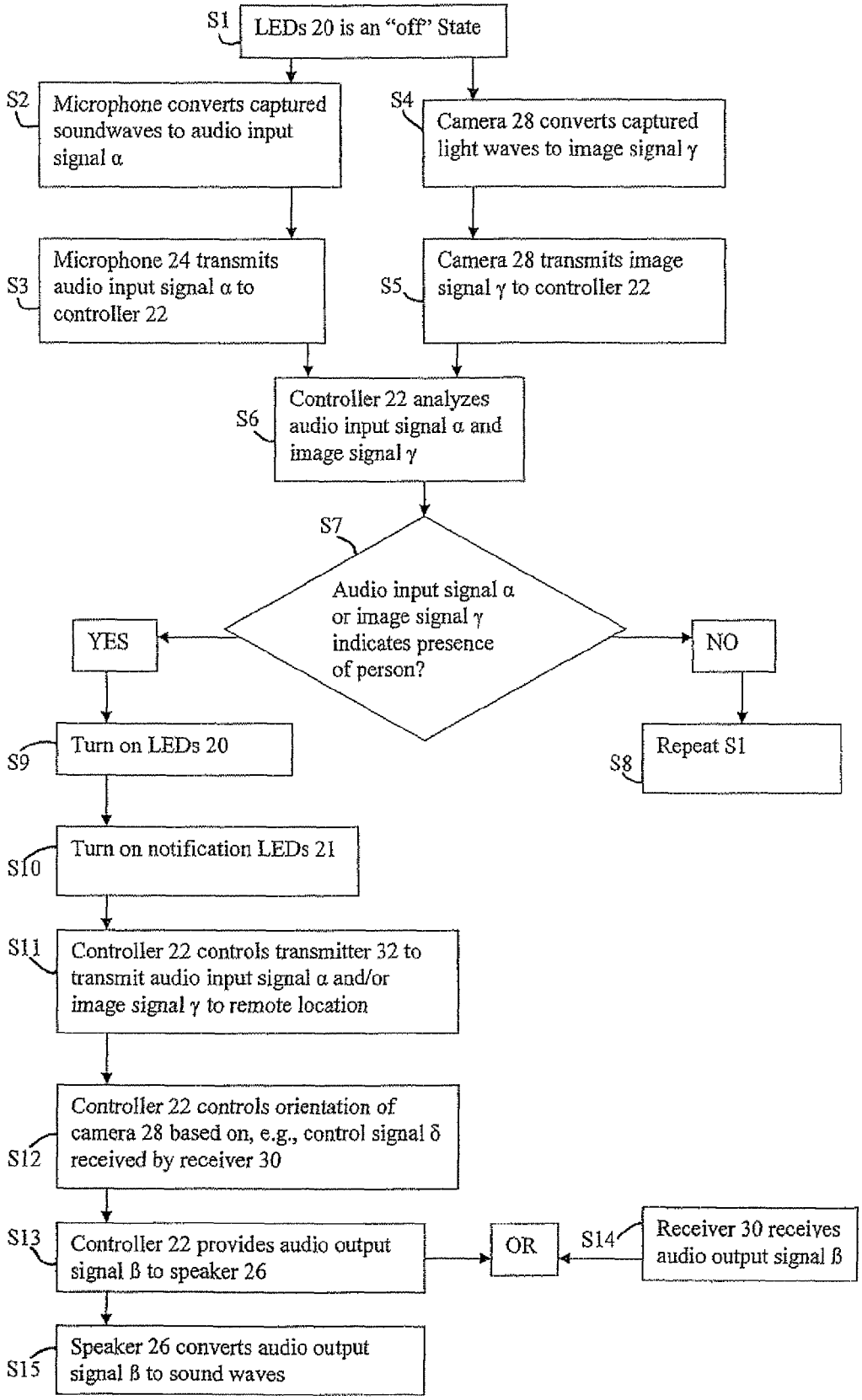
FIG. 2 is a flowchart showing an example of the light and communication system of FIG. 1 in operation.

The system 10 can perform several functions when installed in the fixture 12. For example, as shown in FIG. 2, in step S1 the LEDs 20 are in an "off" state. That is, the controller 22 is not providing power to the LEDs 20. In step S2, the microphone 24 can capture sound waves and convert the sound waves to generate the audio input signal α. In step S3, the microphone 24 can transmit the audio input signal α to the controller 22. Similarly, in steps S4 and S5, respectively, the camera 28 can capture light waves and convert the light waves to generate the image signal γ and transmit the image signal γ to the controller 22. Alternatively, only one set of steps S2 and S3 or steps S4 and S5 can be performed. Additionally or alternatively, the microphone 24 and camera 28 can transmit the audio input signal α and the image signal γ, respectively, to the transmitter 32. Also, while the process of FIG. 2 is described as occurring while the LEDs 20 are in an "off" state, a similar process can be performed when the LEDs 20 are in an "on" state as is described below with reference to FIG. 3.

In step S6, the controller 22 analyzes the audio input signal α and the image signal γ. For example, the controller 22 can analyze the audio input signal α to determine whether a sound over a predetermined volume is produced, whether a spike in sound to a predetermined level greater than a level of normal background noise is produced, whether a series of sounds at similar frequency to footsteps are produced, whether a sound corresponding to human speech is produced, or whether some other sound indicative of the presence of a person is produced. Similarly, the controller 22 can analyze the image signal γ by performing a facial recognition analysis, comparing successive images of video to detect a moving object, or performing another analysis. In step S7, the controller 22 determines whether a person is present based on the analysis of step S6. Alternatively, the controller 22 can analyze the audio input signal α and the image signal γ for the presence of something other than a person, such as a fire if the camera 28 is an infrared camera. Also, instead of or in addition to steps S6 and S7, the transmitter 32 can transmit the audio input signal α and the image signal γ to the remote location, and personnel at the remote location can select an appropriate course of action and transmit the control signal δ to the receiver 30.

In step S8, the controller 22 determines that no person is present, in which case the LEDs 20 remain in the "off" state and the process can be repeated continuously or after a predetermined time. Step S9, however, can be performed if the controller 22 determines that a person is present. In this case, any of steps S9 through S15 can be performed, though in another example fewer than all of steps S9 and S15 can be performed.

In step S9, the controller 22 turns on the LEDs 20. The controller 22 can turn the LEDs 20 on to operate in a normal mode in which the LEDs 20 produce a generally constant flux of light, or the controller 22 can operate the LEDs 20 in an alarm mode in which the LEDs 20 flash or produce some other pattern of light. Similarly, in step S10, the controller 20 can turn on the notification LEDs 21, thereby producing a red light that can provide a warning or other message to a viewer.

Additionally, in step S11, the controller 22 can instruct the transmitter 32 to transmit the audio input signal α and the image signal γ to the remote location. Thus, personnel at the remote location can take appropriate action, such as transmitting the control signal δ to the receiver 30, or the audio input signal α and the image signal γ can be recorded for later viewing. Step S12 shows an example of personnel at the remote location transmitting the control signal δ to the controller 22 via the receiver 30. As shown, the control signal δ can include an instruction for the controller 22 to change the orientation of the camera 28 (e.g., by controlling a motor coupled to a pivot on which the camera 28 is mounted).

In step S13, the controller 22 can provide the audio output signal β from its memory to the speaker 26. The audio output signal β can correspond to an alarm sound, a pre-recorded warning (e.g., "Exit the building."), or some other sound. In step S15, the speaker 26 can convert the audio output signal β into sound waves. Instead of having the speaker 26 produce the audio output signal β as stored on the memory portion of the controller 22, step S14 shows an additional example of a response of personnel at the remote location in which the personnel transmit the audio output signal β to the receiver 30. In this case, the audio output signal β can be, for example, a message spoken by personnel at the remote location. This audio output signal β can also be converted to sound waves by the speaker 26 in step S15.

Figure 3:
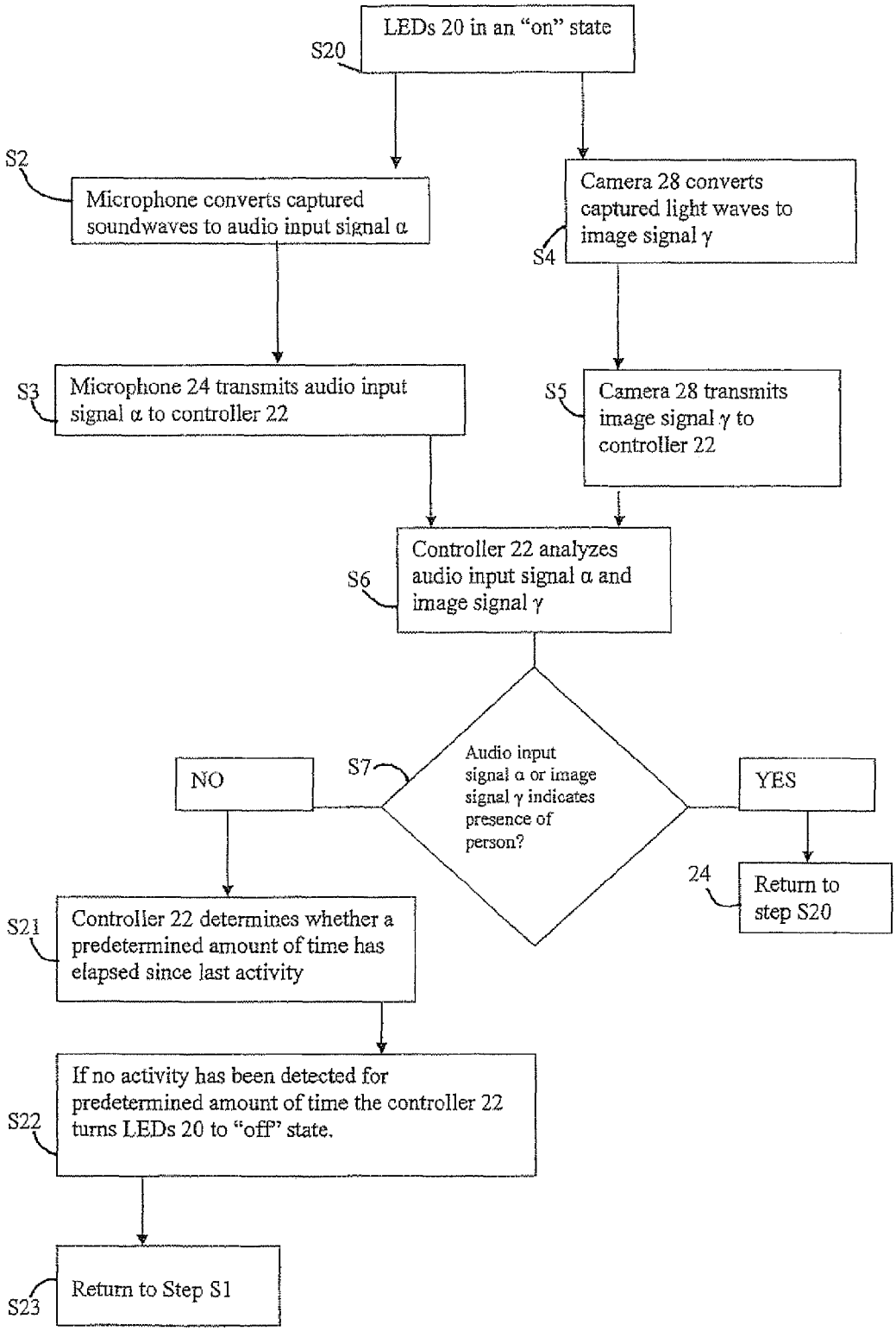
FIG. 3 is a flowchart showing another example of the light and communication system of FIG. 1 in operation.
Figure 4:
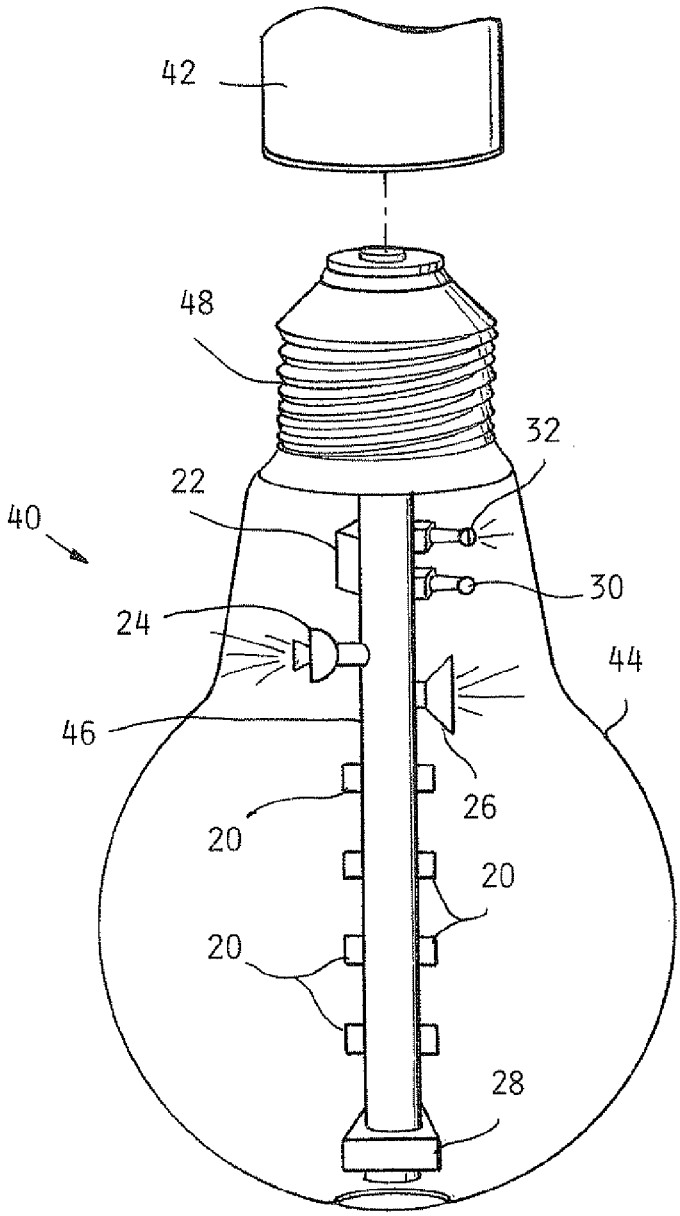
FIG. 4 is a perspective view of another example of a light and communication system.

Another function of the light and communication system 10 is shown in FIG. 3. In step S20, the LEDs 20 are in an "on" state. Steps S2 through S6 can be then be performed as described with reference to FIG. 2. However, while steps S2 through S7 are continuing to be performed continuously or at intervals, the controller 22 in step S21 determines whether a predetermined amount of time (e.g., five minutes) have passed since activity indicating the presence of a person was last detected in step S7. As shown in step S22, if no person has been detected for the predetermined amount of time, the controller 22 can turn off the LEDs 20. After turning the LEDs 20 off, the controller 22 can return to step S1 as shown in FIG. 2.

Additionally, the light and communication system 10 can perform other functions. For example, when a building is in an unoccupied state (e.g., at night or over a vacation period), the controller 22 can provide power to the LEDs 20 at times to give the appearance of activity in the building. Providing power to the LEDs 20 when the building in an unoccupied state can give the appearance of activity in the building to deter trespassers from entering the building. As another example, while the example discussed above in reference to FIG. 2 describes the camera 28 as providing the image signal γ to the remote location upon the detection of the presence of a person, the camera 28 can alternatively provide the image signal γ at a certain time interval (e.g., every fifteen seconds) for analysis by security personnel or to be stored for review in the event a break-in or other incident occurs. As yet another example, the controller 22 can turn on the camera 28, record images captured by the camera, or cause the images captures by the camera 28 to be sent to the remote location based on the audio input signal α (e.g., when the audio input signal α indicates the presence of a person).

The light and communication system 10 offers many advantages. The system 10 can be installed in the standard fixture 12 with no additional wiring, as the entire system 10 can be contained in a single package defined by the housing 14 and end caps 18, allowing for easy and inexpensive implementation of a communication system in a building. The system 10 can be installed in a "smart" building for communication with other components. For example, the receiver 30 can receive the control signal δ from a door ajar sensor separate from the system 10 with instructions to turn on the LEDs 20. Alternatively, the system 10 can be installed in a conventional building to transform the building into a "smart" building.

While the system 10 is shown and described as including the microphone 24, the speaker 26, the camera 28, the receiver 30, and the transmitter 32, another example of the light and communication system can include fewer components (e.g., another example of the system may not include the receiver 30). Also, while the controller 22, audio device, camera 28, receiver 30, and transmitter 32 are described as separate components, one or more of the components can be integral (e.g., single component can function as both the receiver 30 and transmitter 32).

FIG. 4 shows another example of a light and communication system 40 for installation in a standard incandescent socket 42 as mentioned above. A bulb shaped housing 44 can enclose a circuit board 46 in electrical communication with a standard screw base 48, such as an E26 Edison threaded screw base. LEDs 20, the controller 22, the microphone 24, the speaker 26, the camera 28, the receiver 30, and the transmitter 32 can be mounted on the circuit board 46. The camera 28 can be mounted near a tip of the bulb for a wide viewing angle, or multiple cameras 28 can be used.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structures as is permitted under the law.

What is claimed is:

1. A lighting and communication system for use in a standardized light fixture, the lighting and communication system comprising:

a light source;

a communication apparatus;

wherein the communication apparatus is at least one of an audio device or a camera;

a housing at least partially enclosing the light source and the communication apparatus; and at least one electrical connector configured for physical and electrical connection to the standardized light fixture, the at least one electrical connector electrically connected to the light source and the communication apparatus, wherein:

the at least one electrical connector includes a pair of pin-carrying connectors, and the housing and the pair of pin-carrying connectors at least partially define a single package sized for use in a standardized fluorescent fixture.

2. The lighting and communication system of claim 1, wherein the light source includes at least one LED.

3. The lighting and communication system of claim 1 wherein the audio device includes a speaker, and further comprising:

a receiver configured to receive an audio signal; and wherein the speaker is operable to output sound in response to the audio signal.

4. The lighting and communication system of claim 1, further comprising a controller operative in response to the communication apparatus to control a brightness of the light source.

5. The lighting and communication system of claim 1, wherein the communication apparatus includes a memory operative to store a recording; and wherein the audio device is operative to produce a sound corresponding to the recording.

6. The lighting and communication system of claim 1, wherein the light source includes multiple LEDs arranged along a length of the housing.

7. An LED-based light including a lighting and communication system for use in a fluorescent fixture, the LED-based light comprising:

at least one LED;

a communication apparatus;

wherein the communication apparatus is least one of an audio device or a camera; and a pair of pin-carrying connectors for physical and electrical connection to the fluorescent fixture, the connectors electrically connected to the LEDs and the communication apparatus.

8. The LED-based light of claim 7, further comprising:

a receiver configured to receive an audio signal;

wherein the audio device includes a speaker operable to output sound in response to the audio signal.

9. The LED-based light of claim 7, further comprising a controller operative in response to the communication apparatus to control a brightness of the light source.

10. The LED-based light of claim 7, further comprising:

a housing including a light transmitting portion;

wherein the at least one LED is oriented to produce light through the light transmitting portion; and wherein the housing and the pair of pin-carrying connectors define a single package at least partially enclosing the at least one LED and the communication apparatus.

11. A lighting and communication system for use in a standardized light fixture, the lighting and communication system comprising:

a light source;

a communication apparatus;

wherein the communication apparatus is at least one of an audio device or a camera;

a controller operative to control a brightness of the light source in response to an input signal received from the communication apparatus;

a housing at least partially enclosing the light source and the communication apparatus; and at least one connector configured for physical connection to the standardized light fixture, wherein:

the housing and the connector at least partially define a single package sized for use in the standardized light fixture.

12. The lighting and communication system of claim 11, wherein the at least one connector is further configured for electrical connection to the standardized light fixture; and wherein the at least one connector is electrically connected to the light source and the communication apparatus.

13. The lighting and communication system of claim 11, wherein:

the light source includes a plurality of LEDs arranged along a length of the housing;

the at least one connector includes a pair of pin-carrying connectors; and the housing and the pair of pin-carrying connectors at least partially define the single package sized for use in a standardized fluorescent light fixture.

14. The lighting and communication system of claim 13, wherein the housing includes a light transmitting portion; and wherein the plurality of LEDs is oriented to produce light through the light transmitting portion.

15. The lighting and communication system of claim 13, wherein the pair of pin-carrying connectors is further configured for electrical connection to the standardized fluorescent light fixture; and wherein the pair of pin-carrying connectors is electrically connected to the light source and the communication apparatus.

16. The lighting and communication system of claim 11, wherein the light source includes at least one LED.

17. The lighting and communication system of claim 11 wherein the audio device includes a speaker, and further comprising:

a receiver configured to receive an audio signal; and wherein the speaker is operable to output sound in response to the audio signal.

18. The lighting and communication system of claim 11, wherein the communication apparatus includes a memory operative to store a recording; and wherein the audio device is operative to produce a sound corresponding to the recording.

19. The LED-based light of claim 11, further comprising:

a battery electrically connected to at least one of the LED and the communication apparatus.

20. The LED-based light of claim 11, wherein the controller is operative to increase the brightness of the LED in response to at least one of detection of a sound by the audio device and a change between a first image captured by the camera and a second image captured by the camera.

21. The LED-based light of claim 11, wherein the controller is operative to decrease the brightness of the LED in response to the passage of a predetermined amount of time in the absence of at least one of a sound louder than a predetermined value and a change between a first image captured by the camera and a second image captured by the camera.

22. The LED-based light of claim 11, wherein the audio device is operative in response to an image captured by the camera to output sound.

23. The LED-based light of claim 11, wherein the audio device includes a microphone; and wherein the communication apparatus further includes a transmitter to transmit at least one of audio captured by the microphone and an image captured by the camera.

24. The LED-based light of claim 23, wherein the transmitter is configured to wirelessly transmit at least one of the captured audio and the captured image to a remote location.

* * * * *

UNITED STATES PATENT AND TRADEMARK OFFICE

CERTIFICATE OF CORRECTION

PATENT NO. : 8,251,544 B2
APPLICATION NO. : 12/985049
DATED : August 28, 2012
INVENTOR(S) : John Ivey and David L. Simon It is certified that error appears in the above-identified patent and that said Letters Patent is hereby corrected as shown below:

Column 8, lines 33-34, delete “a standardized fluorescent” and insert --the standardized light--.

Signed and Sealed this
Eleventh Day of December, 2012

David J. Kappos

David J. Kappos
*Director of the United States Patent and Trademark Office*